US005082576A

United States Patent [19]

Howson

[11] Patent Number: 5,082,576

[45] Date of Patent: Jan. 21, 1992

[54] REMOVAL OF SULFIDES USING CHLORITE AND AN AMPHOTERIC AMMONIUM BETAINE

[75] Inventor: Mark R. Howson, Hull, England

[73] Assignee: BP Chemicals Limites, London, England

[21] Appl. No.: 491,355

[22] Filed: Mar. 9, 1990

[30] Foreign Application Priority Data

Mar. 21, 1989 [GB] United Kingdom ..... 8906406

[51] Int. Cl.[5] ..... C10G 27/02

[52] U.S. Cl. ..... 507/130; 252/8.552; 423/269; 423/477; 507/131; 507/133; 507/140

[58] Field of Search ..... 252/8.3, 8.552, 391, 252/392, 8.555; 423/477, 269

[56] References Cited

U.S. PATENT DOCUMENTS 1,908,273 5/1933 Taylor ..... 208/190
4,473,115 9/1984 Oakes .
4,594,147 6/1986 Roof et al. .

FOREIGN PATENT DOCUMENTS 1207269 7/1986 Canada .
2170220 7/1986 United Kingdom .

*Primary Examiner*—Robert L. Stoll
*Assistant Examiner*—Gary L. Geist
*Attorney, Agent, or Firm*—Brooks Haidt Haffner & Delahunty

[57] ABSTRACT

This invention relates to a composition suitable for use in process for the removal of sulfides, especially hydrogen sulfide from a feed contaminated therewith. The composition comprises an aqueous solution of a chlorite and a corrosion inhibitor which is an amphoteric ammonium compound of the formula

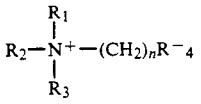

as herein defined. The inhibitor mitigates problems of corrosion associated with chlorite scavengers.

10 Claims, No Drawings

REMOVAL OF SULFIDES USING CHLORITE AND AN AMPHOTERIC AMMONIUM BETAINE

The present invention relates to a process for the removal of sulfides, especially hydrogen sulfide present in a crude oil or hydrocarbon feed contaminated therewith during production or processing of said feed or in water separated from said feed.

Sulfides in general and hydrogen sulfide in particular is an undesirable by-product of crude oil production. These sulfides are toxic, have an obnoxious odor and, in the case of wet hydrogen sulfide, is highly corrosive to carbon steel. R. N. Tuttle et al describe the corrosive aspects of hydrogen sulfide in relation to high strength steels in "$H_2S$ corrosion in Oil and Gas Production", National Association of Corrosion Engineers, 1981.

In view of the above various commercial processes of removing hydrogen sulfide are used as add-on "sweetening" units for the treatment of the so called "sour" crudes. Such "sweetening" units of plants are, however, unattractive due to space or weight limitations especially on off-shore installations. Moreover, the economics of such units are often unfavorable.

Attempts have been made to develop a chemical injection formulation which would react rapidly with the sulfides without giving rise to any undesirable side-effects. Most of the systems of this type now available are based on chlorine or peroxide chemistry. Unfortunately these chemicals are invariably strong oxidizing agents and are also fairly corrosive to carbon steels, especially if the oxidizing agent is present in excess of the amount required to react with the sulfide contaminant. Hence additional corrosion inhibitors may have to be incorporated in such systems to mitigate the corrosive effects of the additive.

One of the most successful chemical species that has been investigated as a sulfide scavenger is a chlorite (including chlorine dioxide). Products based on this active species have been shown both in the laboratory and when used on oil production platforms to react quickly and efficiently with any hydrogen sulfide present. The chemical reaction of chlorite with hydrogen sulfide is given below.

$$ClO_2^- + 2H_2S = Cl^{31} + 2H_2O + 2S$$

However, the use of chlorite and its salts or chlorine dioxide on their own causes the corrosivity of the produced fluids to increase markedly especially when used at an injection rate over and above that required to react with all the hydrogen in such systems to mitigate this undesirable effect. This must be added separately since most of the commonly-used corrosion inhibitors are either incompatible with chlorite due to its very strong oxidising potential or form insoluble precipitates of cannot be used offshore for environmental reasons, e.g. Cr salts.

It has now been found that most of the above problems can be mitigated using specific scavengers which either react with or otherwise render the sulfide contaminant harmless.

Accordingly, the present invention is a composition suitable for use as a sulfide scavenger, said composition comprising an aqueous solution of a chlorite and a corrosion inhibitor, characterised in that the corrosion inhibitor is an amphoteric compound of the formula

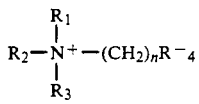

(I)

wherein each of $R_1$, $R_2$ and $R_3$ is the same or different group selected from H, $C_1$–$C_{24}$ alkyl, aryl, halogen, hydroxy, alkoxy, carbonylic and a heterocyclic group formed by a combination of at least two of $R_1$, $R_2$ and $R_3$ and the nitrogen atom, said heterocyclic group optionally containing additional heteroatoms, $R_4$ is a carboxylic or a sulfonic acid group, and n has a value from 1–9. The sulfide contaminant to b escavenged may be present in liquid or gaseous streams or in storage tanks forming part of a chemicals processing plant, e.g. crude oil processing. The contaminant may be present, for instance, in (i) a crude oil feed which is either in an untreated virgin state as recovered from an oil well, or (ii) a feed that has undergone one or more preliminary treatment stages, whether physical or chemical, prior to any cracking step to which the crude oil is subjected, or (iii) an aqueous feed derived as a by-product of chemical manufacturing including crude oil recovery, whether or not associated with crude oil recovered from an oil well. Thus, for example the feed may be crude oil derived or recovered directly from the well or that at any stage immediately prior to the gas/oil separation step, whether or not associated with water.

The most common volatile sulfide found as contaminant in such feeds is hydrogen sulfide.

The type of chloride used may be any chlorite which is soluble in water. Thus, the chlorides are suitably alkali metal chlorites, preferably sodium chlorite.

The amount of the chlorite present in the composition will depend upon the extent to which the sulfide contaminant is to be removed. The precise amount used would depend upon the nature of the sulfide to be removed and the type of feed. Thus for full removal of the sulfide contaminant in a feed, the chloride is preferably used in an amount of at least 0.5 moles per mole of the sulfide contaminant to be removed.

The substituent groups in the amphoteric compounds of formula (I) are suitably such that they are resistant to oxidation by the chlorite component in the composition. Thus in the amphoteric compounds of formula (I) $R_1$ and $R_3$ are suitably $C_1$–$C_4$ alkyl groups, preferably $CH_3$; $R_2$ is suitably a $C_{10}$–$C_{15}$ alkyl group, preferably $C_{12}$–$C_{14}$ alkyl group; $R_4$ is suitably a —COO— group; and n is suitably 1–4, preferably 1–2.

If two or more of the groups $R_1$, $R_2$ and $R_3$ form a heterocyclic ring with the nitrogen atom of the amphoteric compound, the ring so formed is suitably an imidazoline ring.

The amphoteric compound used is most preferably an alkyl betaine, especially lauryl betaine.

The relative proportions of the chlorite and the amphoteric compound in the composition is suitably in the range of 1:0.1 to 1:0.9 w/w respectively, preferably 1:0.4 to 1:0.7 w/w.

The compositions of the present invention are preferably used as aqueous solutions. However, such solutions may optionally contain a water-miscible secondary solvent, e.g. an alcohol or a glycol to enhance the freeze-thaw properties of the composition.

The treatment of the contaminated feed with the compositions of the present invention can be effected at temperatures ranging from below ambient to about 150° C. The scavenger formulations of the present invention are particularly effective in treating wet crude oil, i.e. crudes containing 5-95% w/w water and containing hydrogen sulfide at levels of 1-1000 ppm at a temperature e.g. in the range from 15°-60° C. and a pH e.g. in the range of 4.0-6.9. These formulations are substantially free of any corrosive effects under these conditions.

A feature of the present invention is that the use of these scavenger formulations have significant advantages over those used hitherto: For instance these compositions are:

i) Easy to use and transport offshore
ii) Effective in the wide variety of conditions seen offshore
iii) Fast reacting
iv) Non-corrosive by-products
v) Cost effective
vii) Environmentally acceptable The present invention is further illustrated with reference to the following Examples.

CORROSION RATE MEASUREMENTS

Corrosion rate measurements were performed using LPR (linear polarization resistance) method. A rig was constructed from polytetrafluroethylene (PTFE), nylon and silicone rubber. The rig contained two separate corrosion cells, connected in series but some distance apart. Each cell contained three concentric, mild steel electrodes, 8.6 $cm^2$ surface area, with PTFE spacers.

A multichannel peristaltic pump controlled the addition of all the chemicals through the rig. Concentrations of the various reactants were adjusted to give the desired final concentration of sulfide and scavenger composition in the flowing stream. A flow rate of 45 to 50 $cm^3$ (total fluids) was set. Deareated saline water (4.3% NaCl) buffered to a pH of 4.8 with $NaHCO_3$ and $CO_2$ was treated with 35 to 40 ppm w/w (in fluid) of $H_2S$. Corrosion rate measurements were continuously monitored at the point of injection, cell A, and further downstream, cell B. In this way the most corrosive environment (highest excess of oxidizing agent) and the least corrosive environment (dynamic equilibrium of reactants) were obtained. Sample points of the untreated and the treated $H_2S$ stream enabled assessment of the efficiency of the $H_2S$ scavenging reaction (Iodimetric analysis, see Vogel's Textbook of Quantitative Inorganic Analysis, 4th Edition, Longmans).

The effect of the injection of a solution that contains only sodium chlorite is shown in Table 1. The corrosion rate does not increase above that of the background until the level of the scavenger equals that required to react with all the hydrogen sulfide at this concentration the corrosion rate in the injection cell increases significantly although the downstream corrosiveness is still that of the background. Above this concentration the corrosion rate increases to unacceptable levels. In contrast, Table 2 shows that by incorporating a betaine into the formulation the corrosion rate is controlled to less than 30 mpy even when the injection rate is double that required to react with all the hydrogen sulfide.

TABLE 1

Corrosion Rates in Solutions which contain sodium chlorite

| Conditions | Time (hours) | Corrosion rate (mpy) Cell A | Corrosion rate (mpy) Cell B |
|---|---|---|---|
| NO TREATMENT | 0 | 19 | 19 |
| | 2.3 | 20 | 17 |
| 50% Required | 2.6 | 10 | 12 |
| $NaClO_2$ | 2.4 | 15 | 9 |
| 0% Excess $NaClO_2$ | 3.6 | 37 | 18 |
| | 4.4 | 60 | 25 |
| 50% Excess $NaClO_2$ | 4.6 | 63 | 40 |
| | 5.0 | 63 | 40 |
| 100% Excess $NaClO_2$ | 5.1 | 63 | 63 |
| | 5.5 | 122 | 122 |

NB. hydrogen sulfide generated in the system is 30-35 ppm.

TABLE 2

Corrosion Rates in Solutions which contain sodium chlorite and alkyl betaine.

| Conditions | Time (hours) | Corrosion rate (mpy) Cell A | Corrosion rate (mpy) Cell B |
|---|---|---|---|
| NO TREATMENT | 0 | 10 | 10 |
| | 2.2 | 8 | 8 |
| | 2.3 | 15 | 15 |
| | 2.4 | 53 | 53 |
| 100% Excess $NaClO_2$ + | 2.7 | 35 | 35 |
| Alkyl Betaine | 3.0 | 30 | 30 |
| | 4.0 | 25 | 25 |
| | 5.5 | 25 | 25 |
| $NaClO_2$ only (No | 6.0 | 60 | 60 |
| Alkyl Betaine) | 6.5 | 70 | 70 |

NB. hydrogen sulfide generated in the system is 30-35 ppm.

The above experiments were carried out at ambient temperatures (15°-20° C.) and atmospheric pressures (at sea level but these conditions are rarely seen in real processes occurring offshore, for this reason we undertook some experiments using autoclave to investigate the effect of higher temperatures (60° C.) and pressures (3 bar). The results from these experiments are summarised in Table 3 where the scavenger is again added at twice the concentration required to react with all the hydrogen sulfide. In the absence of the corrosion inhibitor ($NaClO_2$ only) the corrosion rate increases to 86 mpy. In comparison, the incorporation of alkyl betaine (present as 17% w/v in the stock chlorite solution (25% w/v)) lowers this corrosion rate to near that of the original solution. This validates the results of earlier experiments.

TABLE 3

Corrosivity Measurements at 60 deg C. and 3 bar Pressure.

| Conditions | Corrosion rate (mpy) |
|---|---|
| NO TREATMENT | 36 |
| $NaClO_2$ only | 86 |
| $NaClO_2$ + betaine | 45 |

HYDROGEN SULFIDE REMOVAL EFFICIENCIES

Chlorite has been tested with and without lauryl betaine to investigate the influence if any of the corrosion inhibitor on the hydrogen sulfide scavenging ability of the product.

Hydrogen sulfide was generated in situ in a sealed vessel containing brine (92 $cm^3$ of 4% NaCl, 0.1% $NaHCO_3$) and stabilized crude oil (10 $cm^3$ of forties crude), by injection of an aqueous $Na_2S$ solution (2.6 $cm^3$ of 0.029M) and sulfuric acid (5.6 $cm^3$ of 0.05 m).

The resultant pH was 6.2 to 6.4. The $H_2S$ scavenger was introduced into the flask and after a predetermined time interval the residual $H_2S$ was determined by injection of 100 $cm^3$ of air through the solution and vented via a Drager tube. Experiments were all conducted at ambient temperatures.

Typical results are given in Table 4. This table clearly shows that the activity of the chlorite is not compromised by the addition of the corrosion inhibitor.

HYDROGEN SULFIDE REMOVAL EFFICIENCIES

Chlorite has been tested with and without lauryl betaine to investigate the influence if any of the corrosion inhibitor on the hydrogen sulfide scavenging ability of the product.

Hydrogen sulfide was generated in situ in a seated vessel containing brine (92 $cm^3$ of 4% NaCl, 0.1% $NaHCO_3$) and stabilized crude oil (10 $cm^3$ of forties crude), by injection of an aqueous $Na_2S$ solution (2.6 $cm^3$ of 0.029M) and sulfuric acid (5.6 $cm^3$ of 0.05 m).

The resultant pH was 6.2 to 6.4. The $H_2S$ scavenger was introduced into the flask and after a predetermined time interval the residual $H_2S$ was determined by injection of 100 $cm^3$ of air through the solution and vented via a Drager tube. Experiments were all conducted at ambient temperatures.

Typical results are given in Table 4. This table clearly shows that the activity of the chlorite is not compromised by the addition of the corrosion inhibitor.

TABLE 4

| Efficiency Measurements | |
|---|---|
| Product | Hydrogen Sulfide Removal after 15 mins Efficiency % |
| Blank | 0 |
| Sodium Chlorite (25% w/v) only | 99 |
| Sodium Chlorite (25% w/v) containing alkyl betaine (17%) | 99 |

NB: The stoicheometric molar equivalent amount of scavenger was used in order to kill all the hydrogen sulfide. Experiments were carried out at room temperature (20° C.).

I claim:

1. A composition suitable for use as a sulfide scavenger, said composition comprising an aqueous solution of a chlorite and a corrosion inhibitor, characterized in that the corrosion inhibitor is an amphoteric compound of the formula:

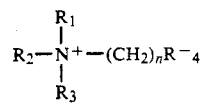

(I)

wherein each of $R_1$, $R_2$ and $R_3$ is the same or different group selected from H, $C_1$–$C_{24}$ alkyl, aryl, halogen, hydroxy, alkoxy, carbonylic and heterocyclic group formed by a combination of at least two of $R_1$, $R_2$ and $R_3$ and the nitrogen atom, said heterocyclic group optionally containing additional heteroatoms, $R_4$ is a carboxylic or a sulphonic acid group, and n has a value from 1–9.

2. A composition according to claim 1 wherein the chlorite is an alkali metal chlorite.

3. A composition according to claim 1 wherein the chlorite is present in an amount of at least 0.5 moles per mole of the sulfide contaminant to be removed.

4. A composition according to claim 1 wherein the substituent groups in the amphoteric compound of formula (I) are resistant to oxidation by the chlorite component in the composition.

5. A composition according to claim 1 wherein in the amphoteric compound of the formula (I), $R_1$ and $R_3$ are $C_1$–$C_4$ alkyl groups, $R_2$ us a $C_{10}$–$C_{15}$ alkyl groups and $R_4$ is a —COO— group and n has a value from 1–4.

6. A composition according to claim 1 wherein $R_1$, $R_2$ and $R_3$ in the amphoteric compound are such that together they represent either an imidazoline ring or an alkyl betaine.

7. A composition according to claim 6 wherein the amphoteric compound is lauryl betaine.

8. A composition according to claim 1 wherein the relative proportions of the chlorite and the amphoteric compound are from 1:01 to 1:09 w/w respectively.

9. A process for the removal of sulfide contaminant in a feed comprising liquid or gaseous streams or in storage tanks forming part of a chemicals processing plant, said process comprising contacting the feed with a composition as claimed in claim 1 at a temperature ranging from ambient to 150° C.

10. A process according to claim 9 wherein the contaminated feed is a wet crude containing 5–95% w/w water and 1–1000 ppm hydrogen sulfide, said feed being contacted at a pH of 4.0–6.9 and at a temperature from 15°–60° C. with a composition according to claim 1.

* * * * *

UNITED STATES PATENT AND TRADEMARK OFFICE

CERTIFICATE OF CORRECTION

PATENT NO. : 5,082,576

DATED : January 21, 1992

INVENTOR(S) : MARK R. HOWSON

It is certified that error appears in the above-identified patent and that said Letters Patent is hereby corrected as shown below:

Col. 1, l. 47 change "$Cl^{3+}$" to --$Cl^{-}$--

Col. 2, l. 15, correct the spelling of the word "be"

Col. 2, l. 33, correct the spelling of the word "chlorite"

Col. 2, l. 34, correct the spelling of the word "chlorites"

Col. 2, l. 41, correct the spelling of the word "chlorite"

Col. 5, l. 20, change "seated" to --sealed--

Signed and Sealed this

Twenty-fifth Day of May, 1993

*Attest:*

Michael K. Kirk

MICHAEL K. KIRK

*Attesting Officer*

*Acting Commissioner of Patents and Trademarks*